United States Patent [19]

Smith

[11] 3,934,524

[45] Jan. 27, 1976

[54] MACHINE AND METHOD FOR PRODUCING DENSE PILE FABRIC

[75] Inventor: Randel P. Smith, Chattanooga, Tenn.

[73] Assignee: The Singer Company, New York, N.Y.

[22] Filed: May 6, 1974

[21] Appl. No.: 467,335

[52] U.S. Cl. ..... 112/79 A; 112/158 A; 112/266

[51] Int. Cl.[2] ..... D05C 15/14

[58] Field of Search ..... 112/203, 208, 209, 205, 112/79.6, 79 A, 266, 410, 158 A, 121.12, 121.14, 79 R, 158 R

[56] References Cited

UNITED STATES PATENTS

| | | | |
|---|---|---|---|
| 3,291,082 | 12/1966 | Fukunaga | 112/158 A |
| 3,455,258 | 7/1969 | Kasuga | 112/158 R |
| 3,577,943 | 5/1971 | Watkins | 112/79 R |
| 3,580,199 | 5/1971 | Vigorelli | 112/158 R |

*Primary Examiner*—H. Hampton Hunter

*Attorney, Agent, or Firm*—Marshall J. Breen; Chester A. Williams, Jr.; Alan Ruderman

[57] ABSTRACT

Apparatus and method of making a very dense tufted fabric using a programmed intermittent backing fabric feed in combination with means for changing the relative lateral displacement of the point of needle penetration into the backing fabric. The method in general comprises feeding a backing fabric through the machine, tufting stitches into the backing, stopping the fabric feed and initiating relative lateral displacement between the backing fabric and the needles, tufting additional stitches into the backing fabric and either initiating further relative displacement between the backing fabric and the needles and tufting again or feeding the fabric forward and repeating the process.

11 Claims, 8 Drawing Figures

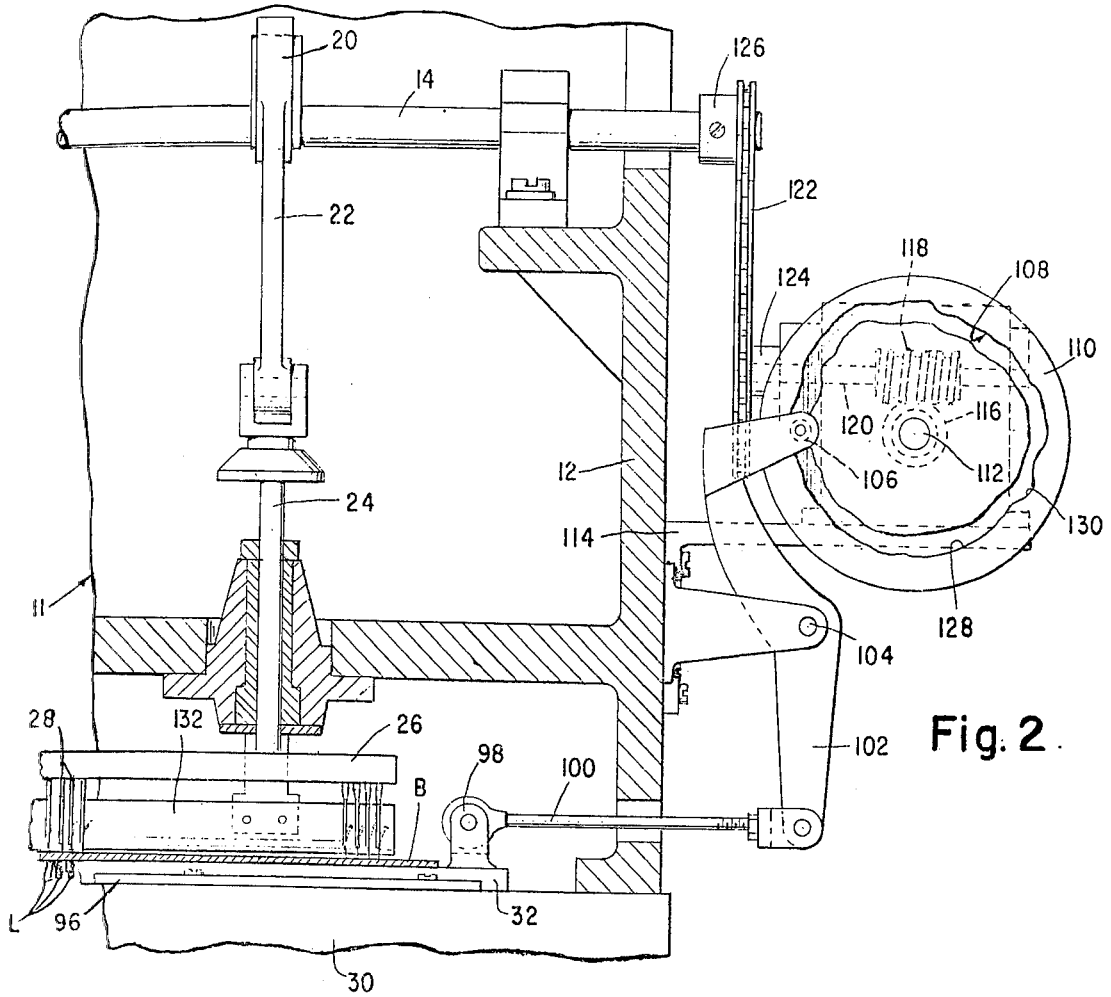
Fig. 2
Fig. 4
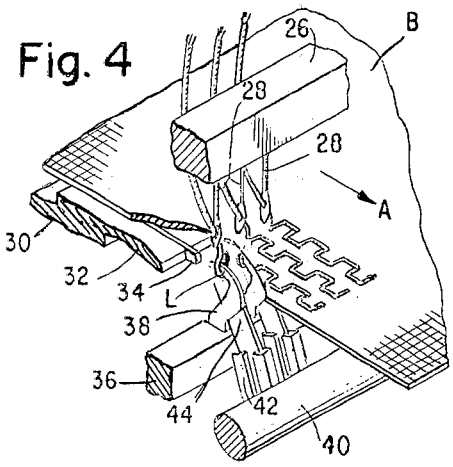
PRIOR ART
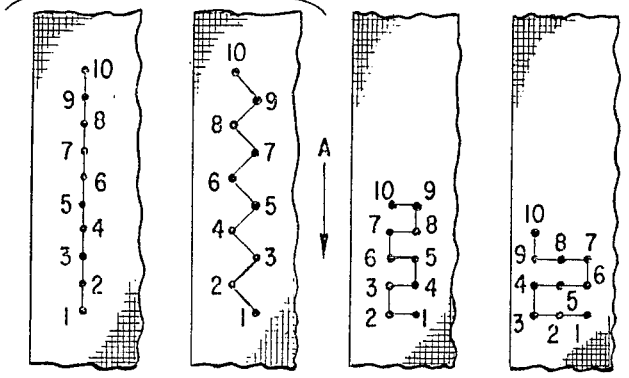
Fig.5a Fig.5b Fig.6a Fig.6b

MACHINE AND METHOD FOR PRODUCING DENSE PILE FABRIC

BACKGROUND OF THE INVENTION

The present invention relates to tufting machines, and more particularly, to a novel method and apparatus for inserting more tufts into a backing fabric to produce a novel fabric of very high pile density.

In the past it has been known to use an intermittent step-by step feeding mechanism for the feeding of the backing fabric longitudinally through a tufting machine. One such arrangement is shown in U.S. Pat. No. 2,411,267, but as in other such arrangements the fabric is fed each time the needle bar is raised. Thus, each needle makes one penetration in each lateral or transverse row.

It is also been known to initiate relative lateral movement between the backing fabric and the needles of the machine in order to relatively laterally displace longitudinal rows of stitching and thereby provide patterning effects. Examples of this method are disclosed in U.S. Pat. Nos. 2,411,267, 3,026,830 and 3,301,205. However, when using such relative lateral displacement with a continuous feeding or with the known intermittent step-by-step mechanisms, the gauge of the fabrics, i.e., the spacing between adjacent needle penetrations in each lateral or transverse row, is not different than the gauge or distance between adjacent needles. The density of the finished fabric is related to the gauge of the fabric and this in turn has been limited by the needle gauge.

Two approaches to increasing the density are disclosed in U.S. Sts. Pat. Nos. 3,577,943 and 3,596,617. In the former patent the spacing of the tufts are spaced less than the full needle gauge by shifting the needle plate while maintaining the loops on the loopers and while penetrating the needles into the backing fabric so as to restrain the lateral shifting of the backing fabric while the shifting mechanism continues to shift relative thereto. This machine, however, requires a critical timing of the needles, loopers and shifting mechanism. In the latter patent the needle can be shifted a distance less than its actual gauge by simultaneously shifting the other gauge parts, i.e., the looper and cutting knife, so that the gauge parts remain in registry during relative movement. However, construction of this mechanism was found to be extremely complex.

In all these known prior art attempts to increase the fabric density each needle effects a zig-zag penetration of the backing fabric and thus even though there is a gauge reduction of the finished fabric, the density is not as great as a machine incorporating a smaller needle gauge equal to the transverse spacing of the penetrations. However, it was the space limitations of such a small gauge machine that created the necessity to look to other arrangements in the first place.

SUMMARY OF THE INVENTION

To overcome the limitations of the prior art the present invention provides an apparatus and method for producing very dense fabric by a programmed incremental feeding of the backing fabric and thereafter penetrating the backing fabric while it is stationary to deposit at least two laterally spaced series of tufts. Relative lateral movement between the needles and the backing fabric may be initiated between successive needle penetrations in the same transverse row while the backing fabric feed is stationary. When this relative movement is less than the needle gauge not only is the fabric gauge increased, but since there are more tufts formed per transverse row, the density is increased accordingly. Thus, the effect is the same as a machine having a correspondingly smaller needle gauge. For example, a ⅜ inch gauge machine can make ⅛ inch gauge fabric by relatively transverse shifting in three steps of ⅛ inch for each step forward. Each yarn thus forms a substantially open rectangular form on the underside of the backing fabric. Moreover, the inventive concept may be used to produce novel patterning effects by relative lateral shifting between the needles and backing fabric only in selective transverse rows and not shifting of shifting a greater or lesser amount in other transverse rows. This would create a specially unique pattern when various needles are threaded with different color yarn. Furthermore, by penetrating and depositing two or more tufts in selected points of penetration, unique effects are also possible.

It is therefore a primary object of this invention to provide a novel method and apparatus for producing a high density tufted fabric.

Another object of this invention is to provide apparatus for controlling a tufting machine to tuft fabric of a gague less than the nominal gauge of the tufting machine.

A further object of this invention is to provide a method of tufting fabric in a multi-needle tufting machine by which more tufts are inserted in each transverse row of the backing fabric than there are needles transversely across the machine.

A yet further object of this invention is to provide a method by which more rows extending in the direction of feed may be produced by a tufting machine than there are needles in the machine transverse to the direction of feed.

A still further object of this invention is to provide a method which can produce more longitudinally rows of tufts in every transverse row of fabric than heretofore possible.

A yet still further object of this invention is to provide a tufted fabric having a plurality of transverse rows extending longitudinally and in which a single strand of yarn forms at least two tufts in each transverse row.

Another object of the invention is to provide apparatus and method in which the needles of a tufting machine deposit a first series of transversely spaced tufts in a backing fabric, thereafter initiate relative lateral movement between the needles and the backing fabric for depositing a second series of transversely spaced tufts laterally spaced from the first series and thereafter either initiating further relative lateral movement between the needles and the backing fabric one or more times to deposit a third or more series of transverse tufts laterally spaced from the first two, or longitudinally feeding a discrete increment of feed lengths, and repeating the operation.

BRIEF DESCRIPTION OF THE DRAWINGS

The particular features and advantages of the invention as well as other objects will become apparent from the following description taken in connection with the accompanying drawings, in which:

FIG. 2 is a fragmentary sectional view taken through the tufting machine of FIG. 1;

FIG. 4 is a fragmentary perspective view of the tuft forming elements of the machine of FIG. 1 illustrating one form of increased density pattern on the backside of a backing fabric;

FIGS. 5*a* and 5*b* are diagrammatic views of the backside of a tufted fabric of the prior art showing the points of penetration and yarn of a single needle of a tufting machine, FIG. 5*a* illustrating the stitches of a conventional tufting machine while FIG. 5*b* illustrates the stitching made by a machine in which relative lateral shifting movement between the needles and the backing fabric occur in combination with a continuous feed of the backing fabric; and FIGS. 6*a* and 6*b* are diagrammatic views of two possible needle penetration arrays of only one needle and the yarn inserted thereby in accordance with the teachings of the present invention, FIG. 6*a* illustrating the effect when there is a first penetration of the needle into the backing fabric to create a first series of tufts, thereafter initiating relative lateral shifting movement between the needles and the backing fabric with no longitudinal feed, penetrating and depositing a second tuft and thereafter feeding the backing fabric a discrete increment of feed length, while FIG. 6*b* illustrates the stitching effect when there is a second relative lateral shifting between the needles and backing fabric prior to the feeding step.

DESCRIPTION OF THE PREFERRED EMBODIMENT

Figure 1:
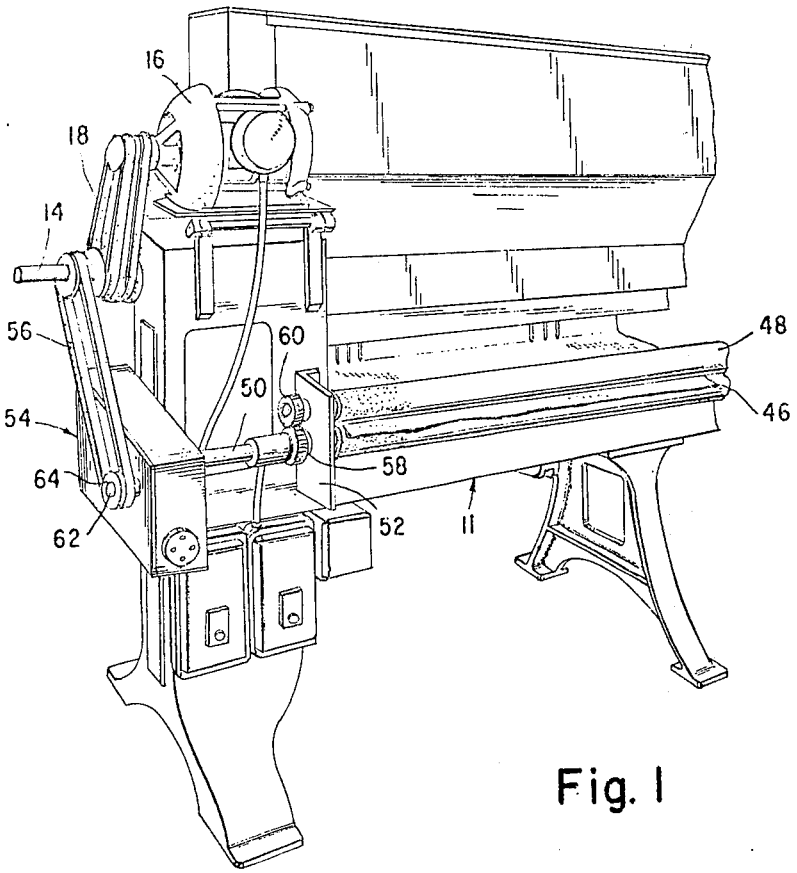
FIG. 1 is a fragmentary perspective view of a tufting machine embodying the present invention.

Referring now to the accompanying drawings there is illustrated a portion of a frame 11 of a tufting machine incorporating a preferred form of the invention. The frame includes, as illustrated in FIG. 2, a head 12 in which a main drive shaft 14 is journaled laterally thereof. The drive shaft 14 is driven by a motor 16 mounted on the frame and connected thereto by means including belts 18. Mounted on the main drive shaft are a plurality of eccentrics 20, only one of which is shown. Each of the eccentrics is connected by a link 22 to a push rod 24 mounted vertically for endwise sliding in the lower portion of the head 12. The lower ends of push rods 24 are connected to a needle bar 26 which carries a plurality of yarn-carrying needles defining a needle bank substantially aligned laterally of the machine. Thus, upon rotation of the main shaft 14 endwise reciprocation is imparted to the needles 28 for penetrating the backing fabric B and to project loops of yarns therethrough.

The frame 11 also includes a bed 30 having a needle plate 32 including a plurality of fingers 34 seated and secured in grooves in the needle plate 32 and extending in cantilever fashion therefrom toward the free ends which are shown as broken away and cross-sectioned for clarity. Beneath the needle plate 32 there is provided in the bed 30 an oscillatory hook shaft 36 securely carrying a plurality of hooks 38, each of which is adapted to cooperate individually with one of the needles 28 to seize the loop L of yarn presented by the needle and to hold the same as the needle is withdrawn to conventionally form loop pile fabric. To tuft cut pile fabric there may be provided adjacent and parallel to the hook shaft 36 an oscillatory knife shaft 40 carrying a plurality of knife brackets 42 in each of which is secured a knife 44. If it is desirable to manufacture both cut pile and loop pile in the same row of stitching a spring clip, as disclosed in U.S. Pat. of Card, No.3,084,645, may be secured to the looper and biased against the bill of the looper at its free end as taught in said patent.

The backing fabric feeding mechanism includes a conventional pair of feed rolls 46 and 48. The picker feel roll 46 is mounted on a shaft 50 journaled on each end in brackets 52, only one of which is shown, and is driven by a transmission, hereinafter described, within a transmission boy 54 attached to the end of the frame 11 and which in turn is driven by a belt 56 from the main shaft 14. The feed guide roll 48 is driven off the shaft 50 by means of a pair of inter-meshing gears 58 and 60. A pair of front feed rolls, not shown, may be positioned in the front of the machine to guide the backing fabric as it is being pulled through the machine by the rear feed rolls, or may be driven in timed relation with the rear feed rolls by conventional means.

Figure 3:
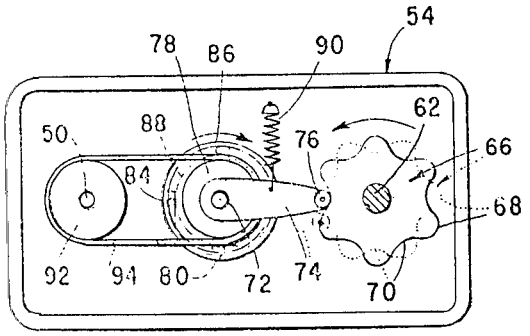
FIG. 3 is an elevational view of the feed transmission box with the end plate removed.

In accordance with the principles of the present invention the feed rolls 46 and 48 are driven in a programmed step-by-step intermittent manner by any one of a number of known drive arrangements, only one of which is now to be described in connection with FIG. 3. Mounted on a stud shaft 62 journaled in the transmission box 54 is a pulley 64 on which the belt 56 is trained so as to drive the same. Also mounted on the stud shaft 62 but within the transmission box 54 is a cam 66 having a plurality of lobes 68 separated by low surfaces 70. Journaled in the transmission box housing 54 is a second stud shaft 72. A follower arm 74 is fixedly secured to the shaft 72 and includes at its free end a journaled follower 76 adapted to ride on the periphery of the cam 66. A pulley 78 is loosely mounted on the shaft 72. Fixed to the shaft 72 is a disk member 80 having one or more slanting notches 82 in which rollers 84 are adapted to loosely rest. A cup shape annular member 86 secured to, or integral with the pulley, and which may include an annular flange 88, confines the rollers within the notches 82. A spring 90 or any other conventional biasing member acts on the follower arm 74 to bias the same against the action of the cam 66 which is rotated continuously. With the direction or rotation of the shaft 62 counterclockwise as illustrated in FIG. 3 the follower 76 is driven downwardly as it is engaged by the leading surface of each lobe 68 of the cam. Thus, the roller 84 is forced into the narrow portion of the notch 82 and is wedged between the annular member 86 and the disk 80 to rrurn the annular member and the pulley 78 in a clockwise direction. The spring 90 acts on the follower arm to pull it upwardly in a counterclockwise direction when the follower 76 has passed the apex of each lobe of the cam. During this motion the roller 84 loosely moves into the wide portion of the notch 82 and does not transmit any motion between the disk 80 and the annular member 86 secured to the pulley 78. An intermittent step-by-step motion comprising drive and no drive intervals is thus transferred from the main drive shaft 14 to the pulley 78. The cam 66 determines the relationship between the rotation of the shaft 14 and the rotation of the pulley 78. The cam 66 may, of course, be selectively interchangeable so that the relation between the drive and no drive portions are possible. A second pulley 92 is fixed to the shaft 50 within the transmission box 54. Trained about both pulley 78 and pulley 92 is a flexible drive member such as a belt 94 which transmits the intermittent motion from the pulley 78 to the picker roll shaft 50 so that the feed rolls are driven in an intermittent step-by-step manner to effect a feed and stop motion to the backing fabric. Thus, the backing fabric can be fed in a stop and go manner according to the program defined by the contour of the cam 66, that is selected.

In order to effect relative lateral shifting movement between the needles and the backing fabric while the backing feed is stationary, the needle plate 32 is illustrated as mounted on the bed for sliding movement laterally of the machine. Other means for effecting this relative lateral shifting movement such as a step over needle bar as illustrated in U.S. Pat. No. 3,026,830 or a fabric shifter may be utilized in place of a sliding needle plate. For illustration purposes, however, a sliding needle plate in accordance with the teachings of U.S. Pat. No. 3,301,205 is shown in the preferred embodiment of the present invention. The needle plate 32 is guided by a bar 96 secured to the bed 30 and abutting the edge of the needle plate opposite the edge from which the fingers 34 extend. At one end of the needle plate 32 there is provided an upstanding lug 98 to which is pivotably connected one end of a link 100. The opposite end of the link is pivotably connected to the lower end of a cam follower lever 102 pivotably mounted intermediate its ends at 104 on the head 12. On the upper end of the lever 102 there is a stud 106 which extends into a cam track 108 of a cam 110, which stud thus constitutes a cam follower. The cam 110 is mounted on a shaft 112 journaled on a bracket 114 on the head 12 and is rotated by a worm wheel 116 on the shaft 112. The worm wheel is driven by a worm 118 on the countershaft 120 which in turn is driven by a chain 122 entrained about a sprocket 124 on the countershaft 120 and a sprocket 126 on the main shaft 14 of the machine.

The cam track 108 is formed with concentric or rest portions 128 disposed at varying radii from the axis of the shaft 112 with active portions 130 intermediate of and smoothly connecting the rest portions 128. The cam 110 is timed such that the stud 106 tracks a concentric portion 128 while the needles are down and will track an active portion 130 when the needles are withdrawn. When the stud is in cooperation with the concentric portion 128 no motion is imparted thereto and the needle plate 32 is thus at rest. When the stud 106 is moved by an active portion 130, which is while the needles are withdrawn, the needle plate 32 is shifted laterally to a new position determined by a rest portion 128 which the studs 106 then tracks. The increment of motion imparted to the needle plate 32 by the active portions 130 of the cam track 108 is a multiple of and preferably, to insure responsiveness of mechanism, equal to the spacing between the fingers 34 so that the needles 28 will always descend between the fingers. As disclosed in the aforesaid U.S. Pat. No. 3,301,205 a presser foot 132 is carried by the head 12 to not only act to prevent the backing fabric B from following the fabric as the needles are withdrawn, but also functions to hold the backing fabric B down on the fingers 34 to hold the pile between the fingers. Thus, the backing fabric B is secured to the needle plate 32 for unitary lateral movement therewith while providing for intermittent longitudinal movement of the fabric relatively to the fingers.

It is to be understood that the cams 66 and 110 are not to be limited to the specific shapes illustrated in the drawings, but may be individually selectively changed to cams of different configurations so as to give various combinations of patterning and density effects to the fabric.

As an illustration of the increase in density capable with the present invention reference may be had to FIGS. 5 and 6. FIG. 5*a* illustrates the backside of a backing fabric made by a single needle of a conventional tufting machine having no relative lateral shifting movement between the needle and backing fabric and having a continuous feed. FIG. 5*b* illustrates a similar view in which there is a relative lateral shifting movement of one or less gauge shifts and having a continuous backing fabric feed. It can be seen from the zig-zag penetration pattern of the backing fabric that although there is a gauge reduction in the finished fabric, the density of the product is not as great as a machine having a smaller needle gauge equaled to the transverse spacing of the penetrations. For example, for each ten needle penetrations made by a single needle in a conventional machine FIG. 5*a* illustrates that there is a single row in the direction of fabric feed A, while in FIG. 5*b* although penetrations 2, 4, 6, 8 and 10 are laterally displaced from penetrations 1, 3, 5, 7 and 9 there is still the same number of penetrations made by a single needle in the longitudinal direction of feed. If a machine incorporates a needle gauge equal to the lateral spacing between penetrations 1 and 2, for example, such a machine, would produce a fabric having substantially twice the density as that illustrated in FIG. 5*b*, since it would have made twice as many penetrations in the same increment of feed.

On the other hand, a fabric produced using the method and apparatus of the present invention can have a density much higher than that previously possible. Two such examples are illsutrated in FIG. 6. FIG. 6*a* illustrates the backside of the backing fabric when the cams 66 and 110 are selected such that the needle penetrates the backing fabric at two laterally spaced locations while the backing fabric feed is stationary, i.e., relative lateral movement between the needles and the backing fabric is initiated when the needles are raised and there is no longitudinal feed between successive penetrations of the needle through the backing fabric. The feed is thereafter activvated through means, such as disclosed in FIG. 3, to move the backing fabric one discrete increment of feed length, whereupon it is again stopped and the backing fabric is again then penetrated by the needles to form a tuft and lateral shifting movement is thereafter again initiated while the backing fabric feed is stationary. Thus, a single needle, and consequently a single strand of yarn, forms two tufts in each illustrated transverse row. The effect on the density of the finished product is therefore the same as a machine having a needle gauge equivalent to the spacing between for example penetrations 1 and 2. Thus, the density is substantially twice that of the fabric disclosed in FIG. 5*b*. FIG. 6*b* illustrates the effect when the cams 66 and 110 are selected so that there are two relative lateral shifting movements between the needles and backing fabric for each discrete increment of feed length. In this case a single strand of yarn deposited by a single needle forms three tufts in each transverse row, with a corresponding increase in the density of fabric produced. It should thus be clear that the present invention provides apparatus and a method for greatly increasing the density of a finished product produced by a tufting machine. It should also be understood that a tufting machine has a great many needles transversely spaced thereacross so that each needle penetration illustrated in FIGS. 6*a* and 6*b* represent a series of tufts and not merely a single tuft.

Numerous alterations of the structure and method herein disclosed will suggest themselves to those skilled in the art. For example, many novel patterning effects may be obtained by changing the program placed into the machine by the cams 66 and 110. Only a general idea of the many possibilities are suggested above. It is to be understood that the present disclosure relates to a preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed therein is:

1. In a tufting machine including a bank of laterally spaced needles, a needle plate for supporting a backing fabric relative to said needles, means for actuating the needles to penetrate the needle plate and the backing fabric thereon and to insert a series of tufts of yarn into the backing fabric upon each penetration of the needles, means for feeding the backing fabric longitudinally of the needle plate, control means for selectively rendering the feeding means inoperative during at least two successive penetrations of the needles into the backing fabric in accordance with a pattern, and means operative while the feeding means is inoperative for imparting relative lateral movement between said needles and said backing fabric in accordance with a pattern, whereby more than one series of tufts may be selectively inserted laterally into the backing fabric on successive penetrations of the backing fabric by the needles while the feed is inoperative.

2. In a tufting machine as recited in claim 1, wherein said means for imparting relative lateral movement between said needles and backing fabric comprises means for shifting the backing fabric laterally of the machine and relative to the needles.

3. In a tufting machine as recited in claim 2, wherein said means for shifting the backing fabric comprises means for supporting said needle plate for lateral movement, and means for imparting lateral movement to the needle plate.

4. In a tufting machine as recited in claim 1, wherein said means for imparting relative lateral movement between said needle and backing fabric comprises means to move said needle-bank laterally with respect to the longitudinal direction of backing fabric feed.

5. In the method of forming a tufted pile fabric by a tufting machine having a bank of reciprocating needles and means for feeding a backing fabric in a longitudinal direction for penetration thereof by said needles, the improvement comprising the steps of selectively stopping the longitudinal feeding movement of the backing fabric, penetrating the backing fabric with said needles to insert a first series of tufts therein; shifting one of said needle bank and said backing fabric laterally with respect to the other while said feed is stationary, penetrating the backing fabric with said needles to insert a second series of tufts therein laterally displaced from said first series, and thereafter feeding said backing fabric at least one discrete increment of feed length.

6. The improved method recited in claim 5 including the steps of shifting one of said needle bank and backing fabric laterally with respect to the other at least a second shift while said feed is stationary, and penetrating the backing fabric with said needles after each lateral shift to insert a series of tufts.

7. A method of forming a dense pile tufted fabric by a tufting machine having reciprocating needles and means for feeding a backing fabric in a longitudinal direction for penetration thereof by said needles, said method comprising, feeding said backing fabric at least one discrete increment of feed length and then stopping the feed, penetrating said backing fabric with said needles and depositing a first series of tufts therein, initiating relative lateral movement between said needles and said backing fabric at least one discrete shifting increment while said backing fabric feed is stationary, again penetrating said backing fabric with said needles and depositing a second series of tufts therein laterally spaced from said first series of tufts, feeding said backing fabric at least a second discrete increment of feed length and then stopping the feed, and repeating at least the steps of penetrating, initiating relative lateral shifting and penetration again while said backing fabric feed is stationary.

8. In the method recited in claim 7, the additional steps of initiating relative lateral movement between the needles and backing fabric a second discrete shifting increment while the feed is stationary subsequent to depositing said second series of tufts and prior to feeding said fabric said second increment of feed, and thereafter again penetrating said backing fabric with said needles and depositing a third series of tufts laterally spaced from said second series of tufts.

9. A method of forming a dense pile tufted fabric by a tufting machine having reciprocating needles and means for feeding a backing fabric in a longitudinal direction for penetration thereof by said needles said method comprising, penetrating the backing fabric with the needles and depositing a first series of tufts of yarn therein, feeding said backing fabric at least one discrete increment of feed length and then stopping the feed of fabric, again penetrating the backing fabric with the needles and depositing a second series tufts of yarn therein longitudinally spaced from said first series of tufts, initiating relative lateral shifting movement between said needles and said backing fabric at least one discrete shifting increment while said backing fabric feed is stationary, again penetrating the backing fabric with the needles and depositing a third series of tufts of yarn therein, feeding said backing fabric at least a second discrete increment of feed length and then stopping the feed of the fabric, and again repeating the steps of needle penetration, initiating relative lateral shifting and needle penetration while said fabric is stationary before advancing the fabric at least a third discrete increment of feed length.

10. A method of forming dense pile tufted fabric as recited in claim 9, wherein intermediate the steps of depositing a third series of loops and feeding a second discrete increment of feed length there is included the steps of initiating relative lateral shifting movement between said needles and said backing fabric at least one other discrete shifting increment, and penetrating the backing fabric with the needles and depositing a fourth series of tufts therein.

11. In a method as recited in claim 9 wherein the lateral shifting in alternate steps of initiating relative lateral shifting occurs in opposite directions.

* * * * *